US005099745A

United States Patent [19]

Hubbell et al.

[11] Patent Number: 5,099,745

[45] Date of Patent: Mar. 31, 1992

[54] APPARATUS AND METHOD FOR DESIGNING A SPECIALLY PORTED TORPEDO LAUNCHING SYSTEM TO DAMP A SEAWATER PISTON

[75] Inventors: Richard F. Hubbell, West Kingston; George Rosner, Newport, both of R.I.

[73] Assignee: The United States of America as represented by the Secretary of the Navy, Washington, D.C.

[21] Appl. No.: 557,059

[22] Filed: Jul. 25, 1990

[51] Int. Cl.[5] ..... F41F 3/10

[52] U.S. Cl. ..... 89/1.8; 114/238; 188/284

[58] Field of Search ..... 89/1.809, 1.810; 114/238; 188/286, 287, 284

[56] References Cited

U.S. PATENT DOCUMENTS

| | | | |
|---|---|---|---|
| 982,008 | 1/1911 | Knapp | 188/287 |
| 2,173,574 | 9/1939 | Binder et al. | 188/287 |
| 2,848,970 | 8/1958 | Gunning | 114/238 |
| 3,773,025 | 11/1973 | Roeder et al. | 114/238 |
| 4,181,152 | 1/1980 | Nicoloff | 114/238 |
| 4,848,210 | 7/1989 | Bissonnette | 89/1.810 |

FOREIGN PATENT DOCUMENTS

| | | | |
|---|---|---|---|
| 30917 | 10/1926 | France | 188/286 |

*Primary Examiner*—David H. Brown

*Attorney, Agent, or Firm*—Michael J. McGowan; Prithvi C. Lall; Michael F. Oglo

[57] ABSTRACT

The invention is low-noise, low-pressure torpedo launching system having specially designed ports connecting a water cylinder to an impulse tank and to a method for designing such ports. The invention uses specially designed C-shaped water cylinder discharge ports to provide a continuous and minimized pressure gradient as the ports are closed by the water piston. The resulting controlled deceleration of the water piston reduces operational noise, reduces mechanical stresses and eliminates the need for auxiliary dashpot components.

6 Claims, 5 Drawing Sheets

APPARATUS AND METHOD FOR DESIGNING A SPECIALLY PORTED TORPEDO LAUNCHING SYSTEM TO DAMP A SEAWATER PISTON

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates generally to torpedo launching systems and, in particular, to torpedo launching systems having a means for decelerating a sea water piston at the end of its stroke.

(2) Description of the Prior Art

Launching torpedoes from submerged submarines requires a complex sequencing of air and sea water between various primary and peripheral chambers. The torpedo must be loaded into the launch tube with any excess air vented outside the tube. The tube must then be filled with sea water with further venting to clear any residual trapped air. Actual launching of the torpedo requires the rapid transfer of a volume of sea water into the launch tube sufficient to eject the torpedo and to fill the launch tube. The sea water for this transfer is stored in a secondary chamber comprising an ejection pump water cylinder. A large launching piston drives the water from the water cylinder into an impulse tank and then into the launch tube ejecting the torpedo. Decelerating and stopping the launching piston at the completion of its stroke has created special engineering challenges. Severe stresses can be imposed on the launching piston and water cylinder whenever the piston strikes the end wall of the cylinder at the end of the strike. Prior art devices have used various liquid dashpots capitalizing on viscous shear forces for dissipating piston energy in an effort to reduce mechanical operating stresses. These systems have not been completely satisfactory in reducing the operating stresses and further, all require some type of dedicated pump and hardware assembly specially designed solely for decelerating the piston.

Additionally, there is a requirement during the torpedo launch sequence to reduce the detectable noise levels, thereby lessening the vulnerability of the submarine. Prior art systems which allow the launching piston to strike the end wall of the water cylinder have produced high levels of noise. Further, these systems operate with high pressure and high pressure change rates. Noise volume is directly proportional to pressure and its rate of change. Systems using special hardware and pumps for decelerating the launching piston also have the disadvantage of producing excessive noise during operation of the special hardware.

Other disadvantages include excessively high pressure gradients due to rapid piston deceleration, high stresses on pump components, and increased cost due to specially designed auxiliary components.

SUMMARY OF THE INVENTION

The invention relates to a torpedo launching system having a low-noise, low pressure dash pot with specially designed ports connecting a water cylinder and an impulse tank and a method for designing such ports. The novel shape of these ports provides a controlled deceleration of the water piston, thereby eliminating excessive stresses, excessive noise levels and excessive mechanical complexity present in systems using specially-designed auxiliary equipment.

The preferred embodiment of the system uses a plurality of generally C-shaped ports, hereinafter called as C-shaped ports, located around the periphery of the water cylinder at the point of connection with the impulse tank. The shape and size of the ports are developed in an iterative process wherein pressure gradients are calculated using Bernoulli's equations to model the water cylinder and impulse tank flow. The absolute pressures are minimized and the pressure gradients are both minimized and continuous. There is a smooth change in pressure and the rate of build up. Accordingly, it is an object of this invention to reduce both absolute pressure and pressure gradients within the dashpot. It is a further object of this invention to reduce stress in pump components. A further object of the invention is to reduce radiated noise. Yet a further object is to provide a system which may be retro-fitted to existing submarine ejection pumps. Still another object of the invention is to provide a system for performing the dual functions of supplying high pressure sea water to eject weapons while simultaneously creating controlled dashpot pressure for decelerating the piston.

DESCRIPTION OF THE PREFERRED EMBODIMENT

Figure 1:
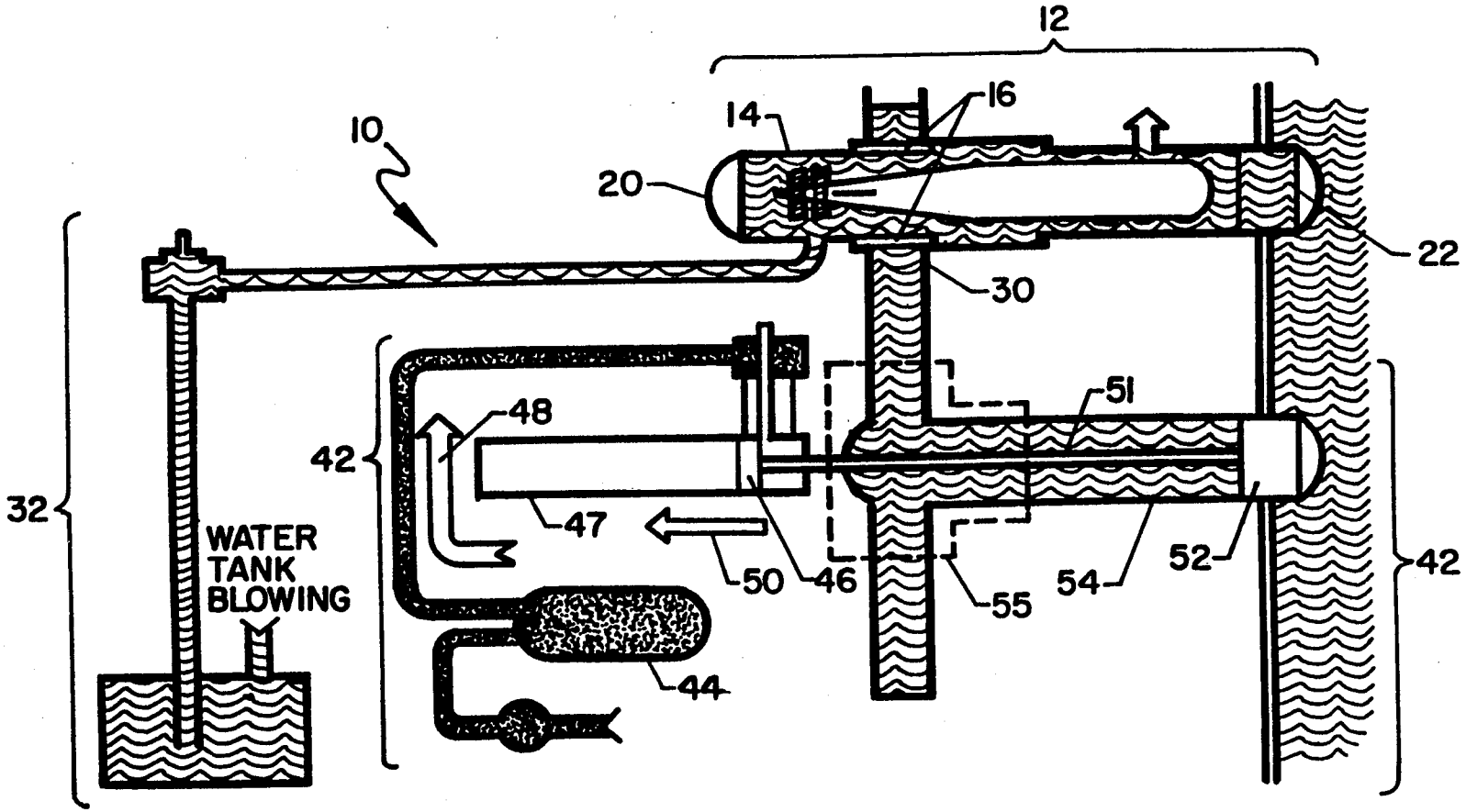
FIG. 1 is a schematic drawing depicting the overall torpedo launching system in the ready position prior to the torpedo ejection.

Referring now to FIG. 1, the torpedo launching system with the damped sea water piston is shown in cross-section and denoted generally by the numeral 10.

The torpedo launching system has three major components, the torpedo tube assembly 12, the flood and drain system 32 and the ejection pump apparatus 42. The torpedo tube assembly comprises a torpedo tube 14 having slide valves 16 connected to impulse tank 30, breech door 20, and muzzle door 22.

Prior to loading operations, all doors and valves in the torpedo tube 14 are closed. Sea water within the tube is drained by use of flood and drain system 32. After loading, the torpedo tube 14 is refilled by flood and drain system 32 so that the loaded torpedo tube is filled with sea water.

The remainder of the launch sequence uses ejection pump apparatus 42 to eject the torpedo from torpedo tube 14. Once the ejection pump apparatus is charged with sea water, impulse flask 44 supplies high pressure air to the connecting rod side of air piston 46. High pressure air flow is shown by arrow 48. The high pressure air drives air piston 46 as shown by arrow 50, pulling water piston 52 by means of connecting rod 51 to the discharge end of water cylinder 54. The launch sequence is completed by the transfer of the water within water cylinder 54 to impulse tank 30 and then in torpedo tube 14, thereby ejecting the torpedo from the torpedo tube. For the purpose of clarity, the sequencing of the various valves and doors is omitted. The novel features of this invention are found in the adjoining ends and interface of impulse tank 30 and water cylinder 54, the interface region being depicted in FIG. 1 by dotted line 55.

Figure 2:
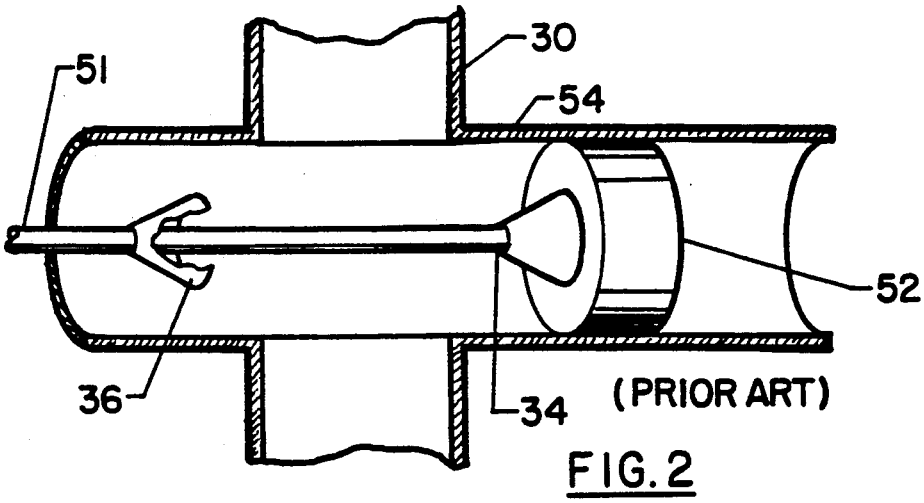
FIG. 2 is a sectional view showing a prior art interface of the water cylinder/impulse tank showing the position of the water piston prior to the end of stroke.

FIG. 2 is a cross-section of the interface region, depicting the adjoining ends of water cylinder 54 and impulse tank 30 as in the prior art. Water piston 52 is shown nearing the end of its stroke, where it would ordinarily be near the completion of the torpedo launch. As water piston 52 nears the end of the firing stroke, a cone 34 attached to water piston 52 enters a cup 36 attached to the end wall of cylinder 54, forming what is known as a cup and cone dashpot. The cup and cone in FIG. 2 are greatly exaggerated for purposes of illustration. Operation of the cup and cone dashpot creates a sudden closure and rapid decrease in the volume. As a result, a high and sudden pressure build-up occurs, which contributes significantly to the generation of noise. Additionally, the cup and cone arrangement is subject to misalignment, caused by normal working of a submarine, which may result in metal-to-metal contact with a further increase in noise. In severe cases of misalignment, the cone may slam into the cup causing extreme noise and physical damage. Realignment and repair can only be accomplished by dry-docking the vessel in a time-consuming and costly procedure. After this type of repair, extensive test dives are required before the submarine is again ready for operational deployment.

This invention eliminates the need for cup and cone devices and any other damping devices, thereby eliminating alignment problems and reducing maintenance requirements.

Figure 3:
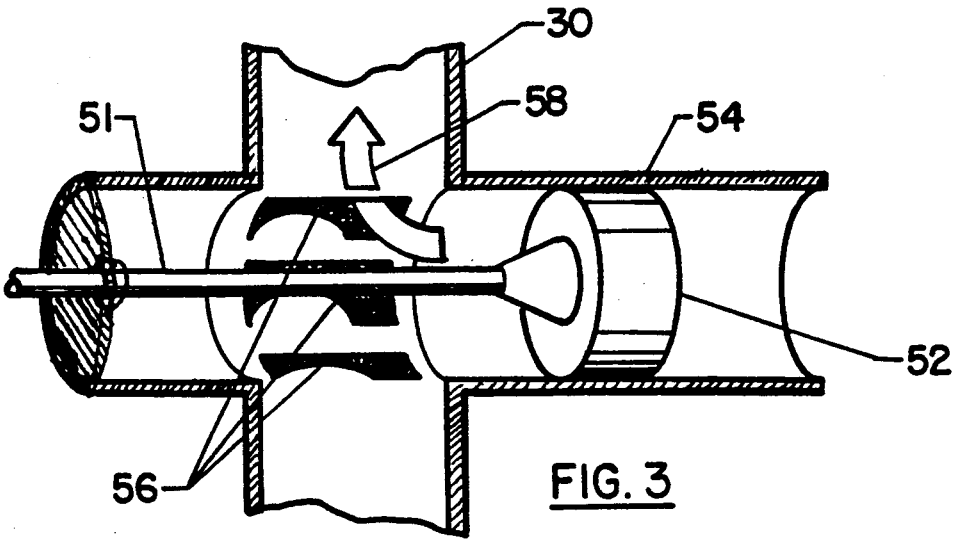
FIG. 3 is a sectional view showing the interface of the water cylinder/impulse tank according to this invention, depicting the relative size and shape of the ports and location of the ports toward the end of the impulse stroke.

FIG. 3 is a cross-section of the same interface region as shown in FIG. 2, showing the unique C-shaped ports or slots of this invention. As water piston 52 moves toward the end wall of water cylinder 54, sea water is forced through C-shaped ports into impulse tank 30. The direction of this flow is shown by arrow 58. At the completion of its stroke, water piston 52 slides across C-shaped ports or slots 56 closing off water flow. The restriction in flow as the ports close decelerates water piston 52 in a smooth continuous stroke.

Figure 4:
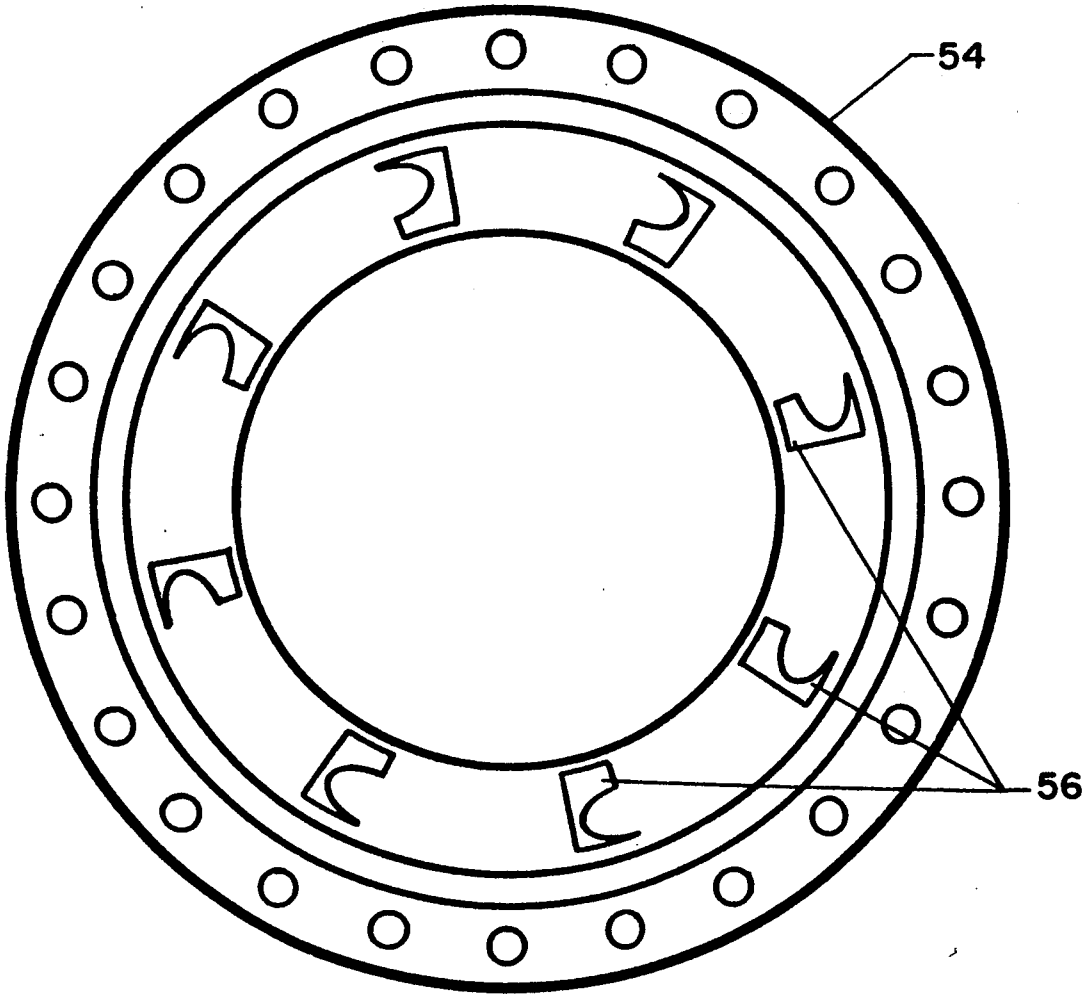
FIG. 4 is an end view of the discharge end of the water cylinder showing the general position of the C-shaped slots or ports.

Referring now to FIG. 4, the end view of the discharge end of water cylinder 54 is shown with eight C-shaped ports 56 located around the periphery.

Figure 5:
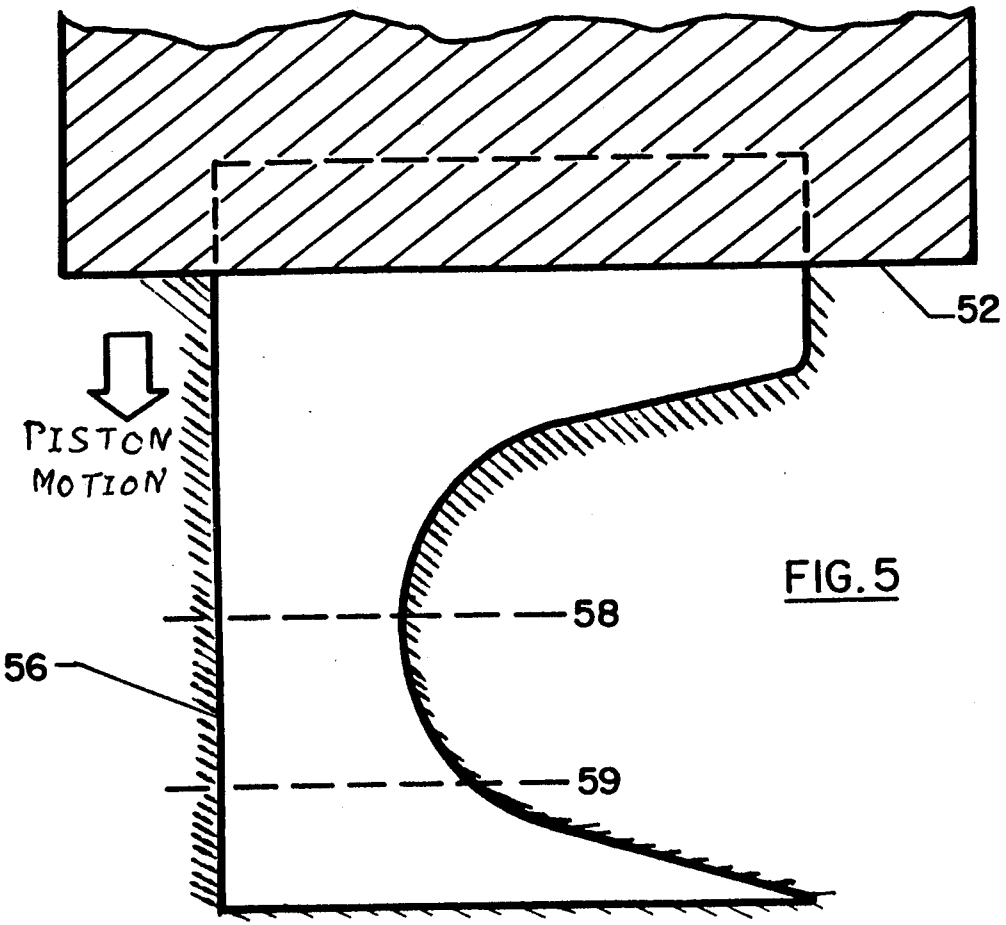
FIG. 5 is a sectional view of a portion of the water cylinder depicting the specific shape of one of the C-shaped ports in the cylinder.

Referring now to FIG. 5, a single C-shaped port or slot 56 is shown. Water piston 52 is depicted at the beginning of its end stroke. The end stroke is that portion of the stroke of water piston 52 where the closing of ports such as 56 begins resulting in the restricting of water flow from water cylinder 54. Port or slot 56 resembles a block letter "C" with a thickened upper portion and a thinned lower portion. This port configuration results in an initial rate of closure greater than the closure at the mid-port position. During closure, two effects take place simultaneously: First, the width of port 56 is decreased so that for equal movement piston 52 closes less area of the port; and second, piston 52 is being decelerated by the restriction in the flow of sea water. This gradual decreasing of the port cross-section or opening 56 prevents a rapid pressure build-up by allowing a relatively large movement of piston 52 with little change in the size of the port or opening. Dotted line 58 depicts the position of the piston head at the point where piston movement causes the least closure of port 56.

After passing dotted line 58, the velocity of the piston is sufficiently slowed that an increase in the rate of port closure is required to maintain pressure. This greater port closing rate is apparent at dotted line 59 where a larger area of the port is closed for a given movement of the piston. The overall effect of simultaneously increase in the rate of closure of the port or opening 56 and, the slowing down of the piston 52 is that the peak pressures or pressure surges are reduced in this embodiment and the low pressures are increased, thereby minimizing both the pressure surges and the pressure changes.

Figure 6:
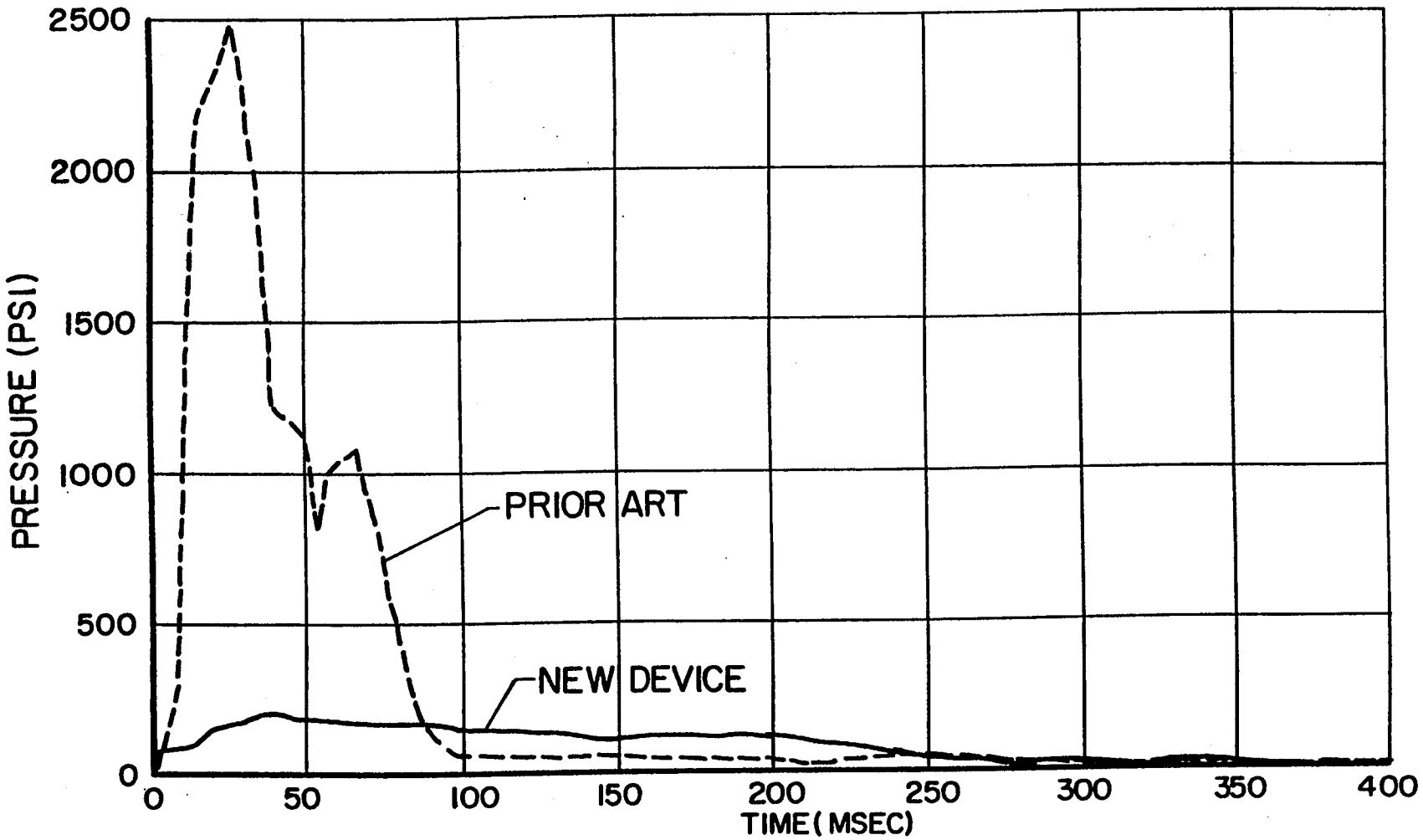
FIG. 6 is a graph of dashpot pressure versus time comparing prior art systems and this invention.

Referring now to FIG. 6, a comparison of dashpot pressures and pressure change rates ($\Delta P/\Delta T$) can be seen in the graphical representation. The prior art device, shown by a dotted line so labeled, is briefly at a lower pressure, but rapidly builds to a peak pressure in less than 30 msec. Further, in approximately 90 msec. the prior art pressure falls below that of this invention. By comparison, this invention provides a smooth low pressure over the first 100 msec. and then provides gradual tapering off of pressure by 250 msec. For reference, the time period from 100 msec. to 250 msec. shows the travel of the water piston in FIG. 5 between dotted line 58 and the bottom of port 56.

When a torpedo is fired, using the prior art technology, water piston 52 is pulled with great force and there is no adequate means to stop or slow it before it strikes the end wall of ejection pump water cylinder 54. Additionally, considerable noise is generated as water piston 52 is suddenly stopped. This noise is radiated through the sea and can be used by hostile forces to detect the presence and location of the submarine. There are numerous devices capable of detecting and evaluating noise to locate a submerged vessel. The present invention eliminates noise generated by the water piston striking the end wall as in prior art systems. Also, operating noise is further reduced as a result of the significant reduction in dashpot pressure. Along with the noise reduction, this invention reduces the high stress placed on the mechanical components of the submarine ejection pump by the impact of the water piston on the impulse tank wall.

Referring now to FIG. 6, dashpot pressure is plotted against time. The dotted line (labeled prior art) shows a sudden rise in pressure peaking at nearly 2500 psi in less than 30 msec. In approximately 90 msec most of the pressure pulse has been completed. From 100 msec. to 300 msec., only a small residual pressure remains. By comparison, the new device shown by the solid line (labeled new device) on FIG. 6, provides a peak pressure of approximately 250 psi in the same 30 msec. This pressure is maintained with only a small decrease, to approximately 200 msec., and then tapers smoothly to zero. Eliminating the pressure peak and sustaining the even pressure level result in a low-noise and low-stress system.

Briefly stated, a specially ported torpedo launching system according to the teachings of subject invention includes a plurality of appropriately configured ports or openings in the interface region of the water cylinder and impulse tank which simultaneously reduce the pressure surges and the pressure is decelerated at the end of the torpedo launching cycle. Thus the design of such a system includes the steps of modeling mathematically the flow system in the interface region between the water cylinder and the impulse tank and simulate different configurations of holes or openings in the water cylinder in interface region such that the pressure surges and the pressure changes in the interface region are reduced and are made smooth and continuous.

The invention as described herein and the specific embodiments in the specification are by way of illustration of the various features and advantages of this invention.

It will be understood that many additional changes in the details, materials, steps and arrangement of parts, which have been herein described and illustrated in order to explain in the nature of the invention, may be made by those skilled in the art within the principle and scope of the invention as expressed in the appended claims.

What is claimed is:

1. A torpedo launching system, providing low-noise and low pressure-gradient operation, comprising:

a torpedo tube assembly having breech and muzzle doors;

a flood and drain system functionally connected to said torpedo tube assembly for charging said torpedo tube assembly;

an impulse tank providing a volume of water for ejecting a torpedo and connected to said torpedo tube assembly with slide valves; and a torpedo ejection assembly for ejecting a torpedo from and functionally connected to said torpedo tube assembly, said torpedo ejection assembly comprising a water cylinder with a plurality of C-shaped ports for controlling water flow into said impulse tank, said plurality of ports being located at the discharge end of said water cylinder.

2. A torpedo launching system as in claim 1 wherein said torpedo ejection assembly further comprises:

a water piston and a first connecting rod located inside said water cylinder for forcing water through the C-shaped ports thereby ejecting a torpedo;

an air cylinder, longitudinally aligned with said water cylinder, and having an air inlet orifice in a side wall;

an air piston and a second connecting rod located inside said air cylinder, the second connecting rod extending out of the air cylinder and joining with the first connecting rod of the water piston, thereby forming a single extended connecting rod having an air piston on a first end and a water piston on a second end; and an impulse flask for storing a volume of high pressure air functionally connected to said air cylinder and operating said air piston.

3. A water cylinder as in claim 2 said C-shaped ports are provided along the interfaced circumference of said water cylinder in communication with said impulse tank.

4. A water cylinder as in claim 2 wherein each of said C-shaped ports in said water cylinder is being formed in the shape of a block letter "C" with a thickened part at the top of the C and a thinned part at the bottom of the C.

5. A water cylinder as in claim 2 wherein the orientation of said C-shaped ports is such that the top of the C extends in the direction of the approach of the water piston.

6. A water cylinder as in claim 2 wherein said plurality of C-shaped ports are shaped to provide a nearly constant and low pressure during the end stroke of a water piston.

* * * * *